United States Patent [19]

Börner

[11] 4,290,196

[45] Sep. 22, 1981

[54] APPARATUS FOR CUTTING FOODSTUFFS

[76] Inventor: Alfred Börner, Industriegebiet, 5561 Niederkail, Fed. Rep. of Germany

[21] Appl. No.: 37,956

[22] Filed: May 9, 1979

[30] Foreign Application Priority Data

May 30, 1978 [GB] United Kingdom ..... 24588/78

[51] Int. Cl.[3] ..... B26B 3/00

[52] U.S. Cl. ..... 36/122; 30/278; 30/279 R; 30/304

[58] Field of Search ..... 30/122, 278, 279 R, 30/304

[56] References Cited

U.S. PATENT DOCUMENTS 4,120,089 10/1978 Börner ..... 30/304

*Primary Examiner*—Stephen G. Kunin
*Assistant Examiner*—J. T. Zatarga
*Attorney, Agent, or Firm*—Irvin A. Lavine

[57] ABSTRACT

The invention relates to apparatus for cutting foodstuffs, comprising a substantially flat body having a fixed cutting blade lying generally in the plane of the body and two separate substantially flat plates each with blades projecting from the plate, one plate being removably mountable with the flat body and the second plate being combinable with the first plate, whereby when the two plates are combined their blades alternate in a direction transversely of the plates as considered in a cutting direction of the apparatus.

7 Claims, 15 Drawing Figures

APPARATUS FOR CUTTING FOODSTUFFS

The invention relates to apparatus for cutting foodstuffs.

According to one aspect of the invention there is provided apparatus for cutting foodstuffs, comprising a substantially flat body having a fixed cutting blade lying generally in the plane of the body and two separate substantially flat plates each with blades projecting from the plate, one plate being removably mountable with the flat body and the second plate being combinable with the first plate, whereby when the two plates are combined their blades alternate in a direction transversely of the plates as considered with respect to the cutting direction of the apparatus.

Thus using the invention it is possible, using the same apparatus, to obtain strips or slices of a variety of sizes.

According to a second aspect of the invention there is provided apparatus as hereinbefore defined in which a first or a first and second removably plate is combined with the substantially flat body.

In order to provide for relatively simple mounting of the one plate and a second plate, the one plate may have guide means and the second plate has side edges whereby the second plate may be slidably mounted in the first plate for combining the two plates.

In order to simplify construction, the guide means may be side walls of the one plate.

Apparatus embodying the invention is hereinafter described, by way of example, with reference to the accompanying drawings, in which.

Figure 1:
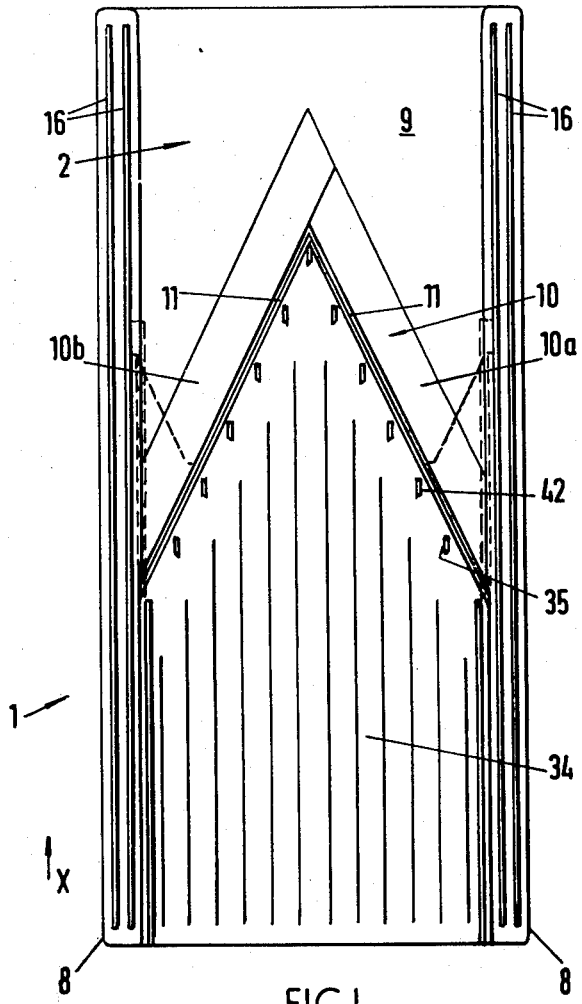
FIG. 1 shows a top plan view of the apparatus with a first removable plate in position.

Referring to the drawings, in which like parts are referred to by like numerals, the apparatus 1 comprises a substantially flat body 2 and separate substantially flat first plates 3 and 34 which are removably mounted in the substantially flat body and second plates 5, 6 and 7 which are removably combinable with the first plates 3 and 34.

The substantially flat body 2 comprises side walls 8 integral with and extending in use below a support plate

Figure 2:
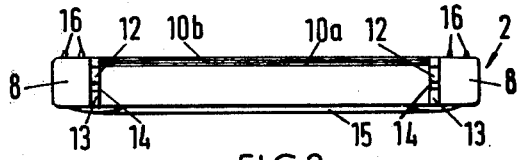
FIG. 2 shows a view in the direction of the arrow of FIG. 1, with the first plate removed.

9 in which is secured a blade 10 of V-shape lying generally in the plane of the substantially flat body 2. The blade 10 merges with the support plate 9 and has a cutting edge 11. The blade 10 is secured to the support plate 9 as by rivets (not shown). The blade 10 comprises two parts 10*a* and 10*b*. The side walls 8 each have guide means comprising upper and lower (as viewed in FIG. 2) strips or rails 12 and 13 which are closed at the end adjacent the blade to form a blind groove 14. The upper rail 12 only extends to a position just short of the point where a blade part 10*a* or 10*b* joins with an adjacent side wall 8. The side walls 8 are connected by a transverse rib 15, and have longitudinal ribs or rails 16 at their upper surfaces.

Figure 3:
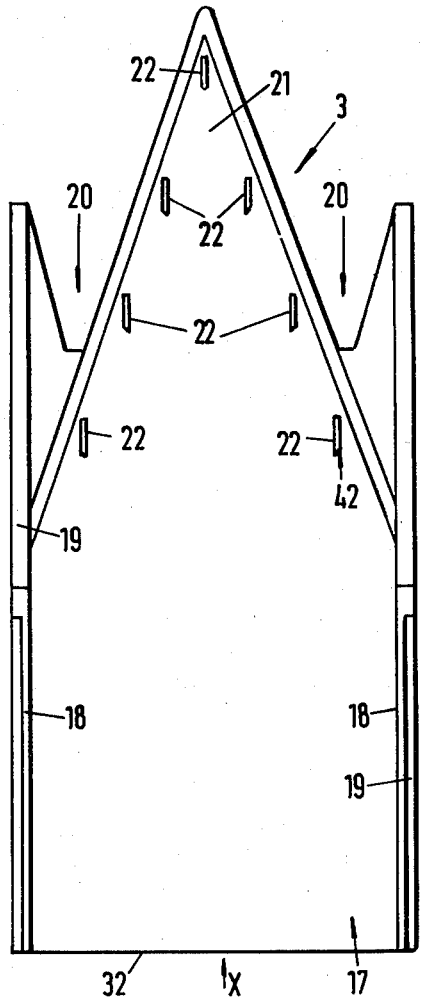
FIG. 3 shows a top plan view of a second embodiment of first removable plate.
Figure 4:
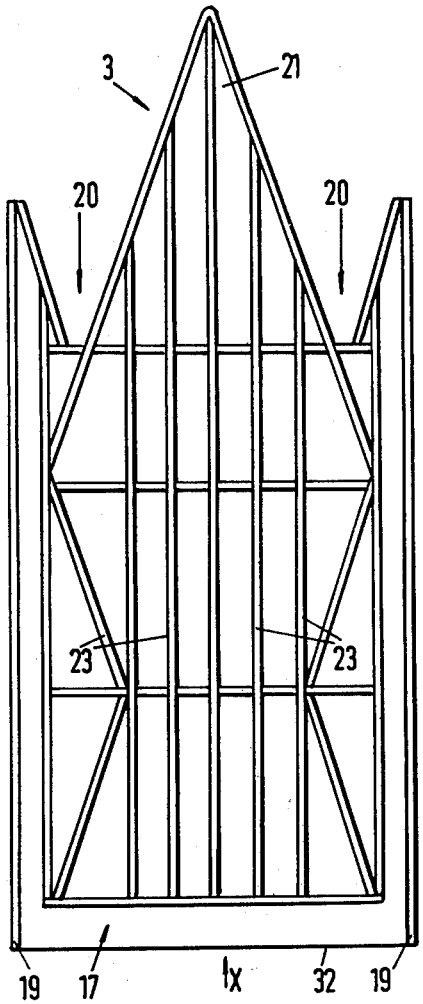
FIG. 4 shows a bottom plan view of the plate of FIG. 3.
Figure 5:
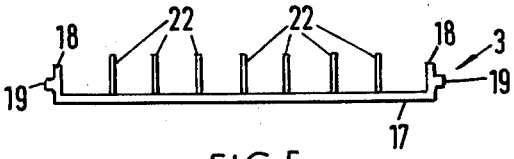
FIG. 5 shows an end elevational view in the direction of the arrow X of the plate of FIGS. 3 and 4.

A first plate 3 shown in FIGS. 3, 4 and 5 can be removably mounted in the flat body 2 as by sliding. The first plate 3 has a flat base plate 17 with upstanding lateral walls 18 and laterally projecting ribs or rails 19 which are complementary with the grooves 14 of the flat body. The flat base plate 17 has side cut-outs 20 and a triangular part 21 in which are mounted substantially vertical cutting blades 22, there being seven shown. The blades 22 are staggered across the cutting direction, which is the direction X. The underside of the first plate has a series of strengthening ribs 23 (FIG. 4).

A second plate 5 (FIGS. 6 and 7) combinable with the first plate 3 comprises a flat plate which has a tapered part 24 in which are mounted vertical cutting blades 25. There is a notch 26 of substantially 'V'-shape between two adjacent blades along convergent sides, as considered in the cutting direction, and an apical notch 27. The underside of the second plate 5 has strengthening means in the form of a boundary wall 28 and a central rib 29 which also gives the correct height of the second plate when in position. The lateral distance between the parallel sides 30 of the second plate 5 is less, preferably just less, than the distance between the side walls 18 of the first plate 3. The distance between the apex of the second plate 5 and the foot 31 of the second plate 5 is such that when the first and second plates 3 and 5 are combined, their feet 31, 32 substantially coincide.

Figure 8:
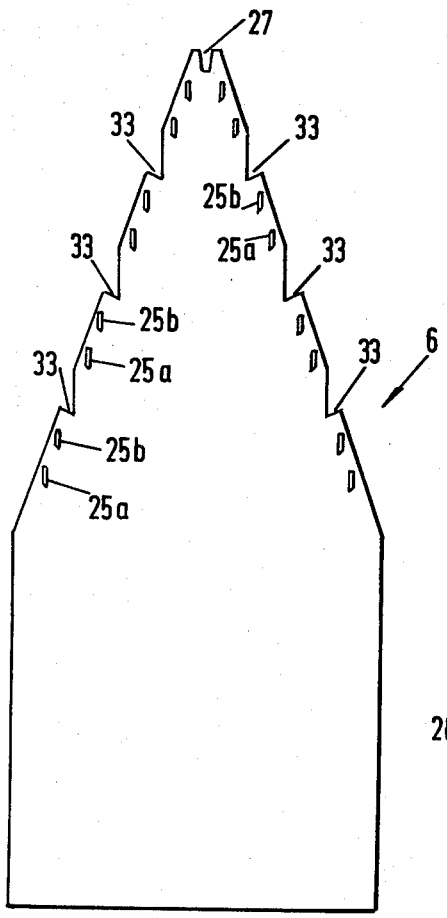
FIGS. 8 and 9 show respective top and bottom plan views of a second embodiment of second removable plate for combining with the first plate of FIGS. 3 to 5.
Figure 9:
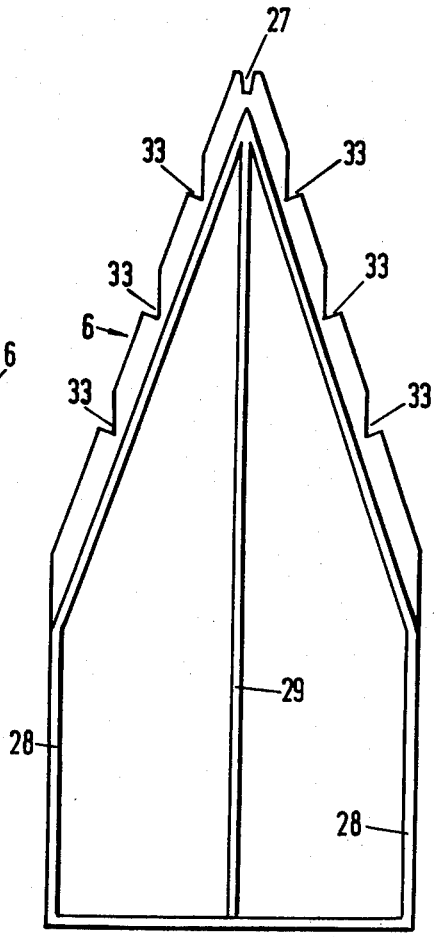
Figure 10:
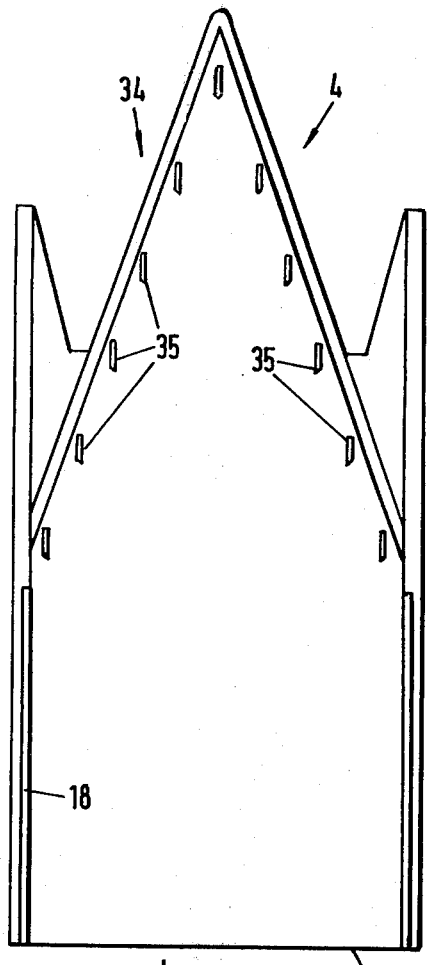
FIGS. 10 and 11 show respective top and bottom plan views of a second embodiment of removable first plate.
Figure 11:
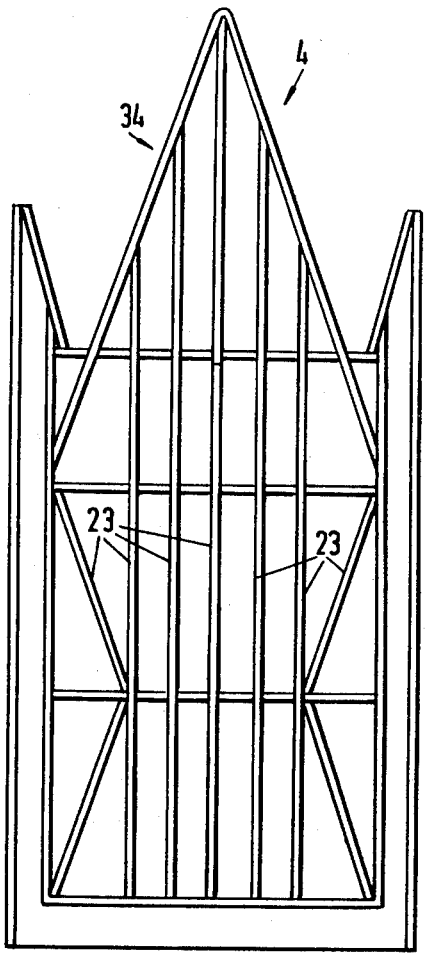
Figure 12:
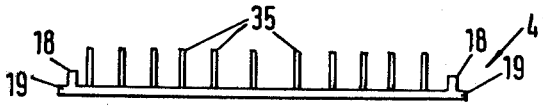
FIG. 12 shows an end elevational view in the direction of arrow Y of the plate of FIGS. 10 and 11.
Figure 13:
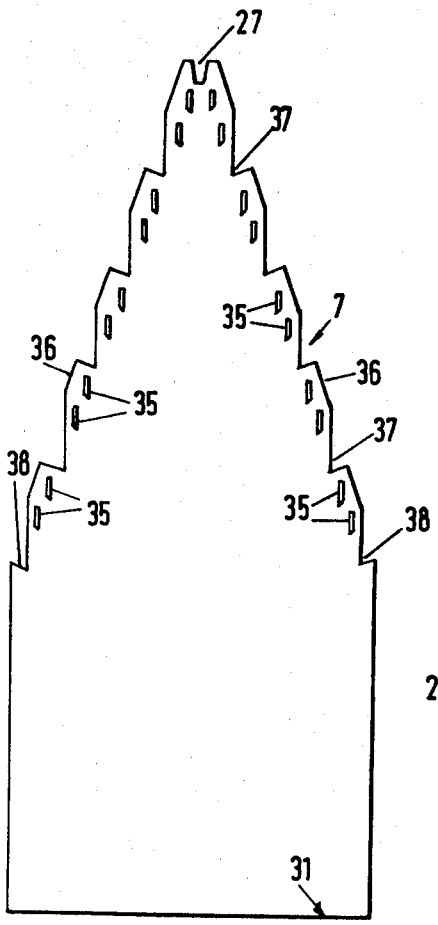
FIGS. 13 and 14 show respective top and bottom views of a second embodiment of second removable plate for combining with the first plate of FIGS. 10 to 12.
Figure 14:
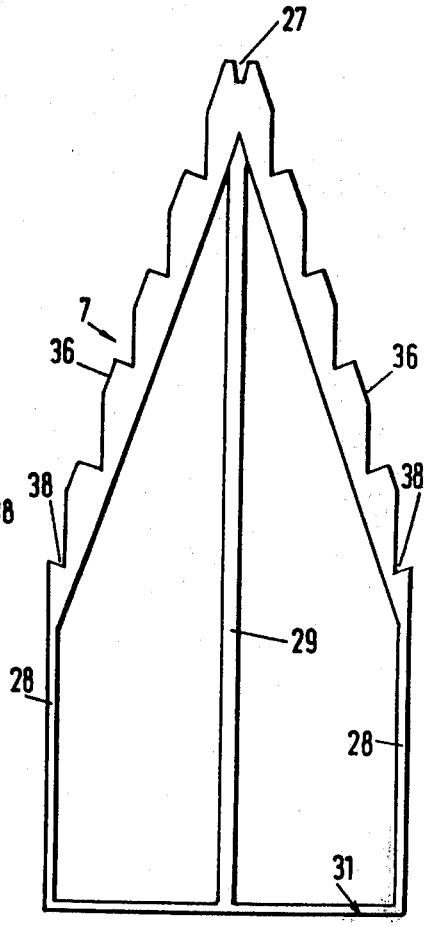

Referring now to FIGS. 8 and 9, there is shown a second embodiment of second plate 6. This plate 6 has a notch 33 after every second blade along one side, so that the blades occur in pairs 25*a* and 25*b* and there is again an apical notch 27.

The apparatus 1 is used to cut chips of thickness varying in the following way.

If relatively thick chips are required, only the first removable plate 3 is used. It is slid into the flat body 2 by engaging the complementary guide means 14 and 19 so that the blades 22 are adjacent the 'V'-shaped blade 10. The distance between the underside of the 'V'-blade 10 and the top of the plate 17 gives the height of the chips. A potato for example is then moved in the direction of the arrow X so that it is sliced by the blades 10 and 22 into strips, the cutting edge of the blades 22 of course pointing in a direction opposite to the arrow X. The blades 10 and 22 together have the effect of slicing the potato both vertically and horizontally, and, as the potato moves beyond the 'V'-blade 10 the cut chips fall away from the apparatus 1 through the cut-outs 20.

Figure 6:
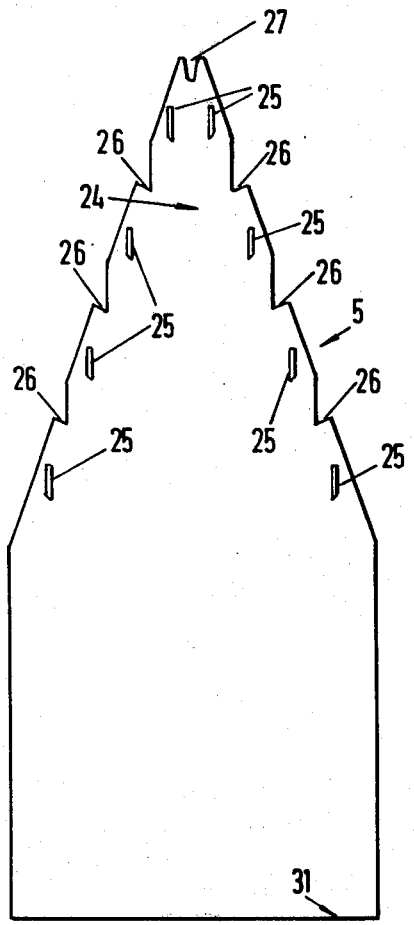
FIGS. 6 and 7 show respective top and bottom plan views of a second removable plate for combining with the first plate of FIGS. 3 to 5.
Figure 7:
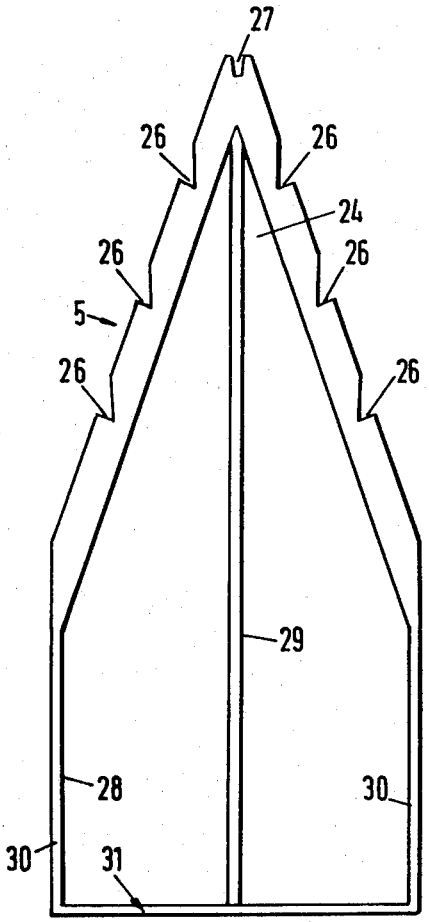

Should it be desired to cut laterally thinner chips, it is merely necessary to combine the first plate 3 with the second removable plate 5 shown in FIGS. 6 and 7 by sliding that second plate 5 between the walls 18 of the first plate 3 until each blade 22 of the first plate enters a notch 26 of the second plate 5. The apical blade of the first plate enters the apical notch 27.

The notches 26 aslo help to locate the two plates one within the other. There are now effectively twice as many blades as considered in a direction transversely of the cutting direction X so that when cutting takes place, thinner chips are produced because the distance between any two blades in the combined apparatus is effectively half that of when the first plate 3 is axed alone.

If it is desired to obtain thinner chips still, for example "French fries", the second plate 5 of FIGS. 6 and 7 is removed and is replaced by the second embodiment 6 of second plate, shown in FIGS. 8 and 9. This plate 6 is similar to the plate 5, except that there are twice as many blades 25*a* and 25*b* along each side, there being two blades, a notch 33 and then two more blades, and so on along each side. Thus the distance between any blade of the combination of plates 3 and 6 is a third that of the first plate 3 alone, so giving very thin chips when a potato is sliced.

The reverse of the plate 6 has strengthening ribs 28 and 29 too.

Referring now to FIGS. 10 to 14, this embodiment of the apparatus 1 is very similar to that of FIGS. 1 to 9. (Indeed FIG. 1 shows the first plate 34 of FIG. 10 mounted in the flat body 2). The plate 34 has eleven blades 35 instead of the seven of the plate 3 and its base 36 is higher than that of the plate so that the blades 35 are shorter than the blades 22, to give vertically thinner chips. Should it be desired to produce laterally thinner (as considered across the cutting direction Y) chips, the plate is combined with the second removable plate 7 (FIGS. 13 and 14) which has twenty blades 35 arranged in five sets of two along each convergent side 36, any two sets of two blades 35 along one side being separated by a notch 37. There is also a notch 38 at each side for receiving the upstream blade of the first plate, as considered in the cutting direction. There is also an apical notch 27.

The plate 7 is slid between walls 18 of the first plate 4, which has rails or projection 19 for engaging in grooves 14, as described with respect to other embodiments.

Figure 15:
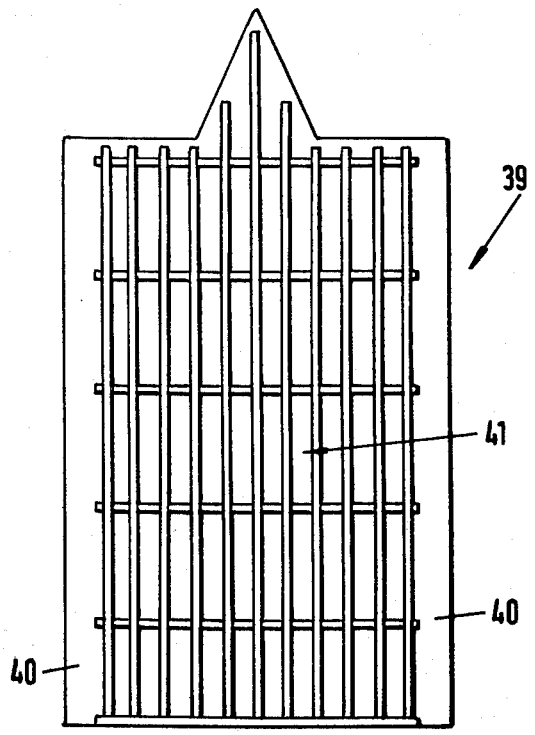
FIG. 15 shows a plan view of a third plate of the apparatus.

If it is desired to cut slices rather than chips, the first and second plates are not used. Rather, the third plate 39 shown in FIG. 15 is slid into position in the flat body 2, lateral edges 40 of the third plate being engageable in the grooves 14. The third plate 39 is reversible and has on one side a surface 41, composed of ribs extending in the cutting direction, which is higher than a surface, again composed of cutting ribs, on an opposite surface (not shown) whereby two thicknesses of slice can be obtained. In other words, the distance between the 'V'-blade 10 and the upper boundary surface of a surface on a particular side of the plate 41 determines the thickness of slice.

The blades 22, 25, 35 are preferably made of metal e.g. stainless steel. All the blades 22, 25 and 35 of every embodiment which extend vertically in use, saving the apical blades of the first or second plates, are preferably sharpened on only that side of the upstream edge i.e. facing the direction of cutting as shown in FIG. 1 which in use is the lateral outermost side 42, i.e. is adjacent the 'V'-blade 10 when the first or second plate is mounted in tee flat body 2. In this way, the cut strips or chips are directed laterally of the apparatus as they are chipped, and this helps to prevent clogging of the apparatus with cut-foodstuff.

The first and second plates are suitably made of plastics in an injection moulding process, the blades being combined with the plastics in the mould during moulding so as to give a relatively simple, efficient one shot process. The blades preferably comprise metal strips of 'L'-shape, the foot of the 'L' being embedded in the plastics. This configuration provides a secure anchorage for each blade as the bent-over foot helps to prevent loosening and subsequent pulling out of the blade from the plastics on repeated slicing operations being carried out.

Using the different combinations of first and second plates described it is possible to provide chips of various sizes e.g. 6 mm, 8 mm, 10 mm and 11 mm wide, though any size could be obtained using suitable blade spacings.

It will be understood that the apparatus may include a holder for foodstuff to be cut or sliced. Such a holder (not shown ) may comprise a hollow body having prongs on which the foodstuff is mounted. The holder slides along the rails and thus protects the fingers of a user when a cutting operation is being carried out.

It will be understood that apparatus embodying the invention and above described is simple to manufacture and in fact saves about 20% of the cost of making conventional apparatus, mainly on the materials required. Also, the use is simplified and the variety of chip sizes increased in a simple way without having constantly to replace one cutter with another.

It will be understood that the invention above described may be modified in various ways. For example, the second plates may not have an apical notch. Furthermore, the cut-outs may not be provided. Also, the plates may be made in any suitable way other than by the injection moulding method described.

The cutting of potatoes has been referred to. It will be understood that any other vegetable, or fruit, can be cut using the apparatus.

I claim:

1. Apparatus for cutting foodstuffs upon linear movement thereof comprising:

(a) a substantially flat body comprising;
  (i) a support plate,
  (ii) a fixed cutting blade secured to the support plate, lying generally in the plane thereof, and extending across said plate,
  (b) first substantially flat plate means comprising:
  (i) plural upstanding cutting blades projecting from the plane thereof, and
(ii) guide means at the edges thereof,
(c) means for supporting said first plate means in spaced, substantially parallel relationship to said support plate with said upstanding cutting blades in the said space and in planes transverse to the plane of said fixed cuting blade,
(d) second substantially flat plate means comprising:
  (i) side edges engaging said guide means of said first plate means,
  (ii) plural upstanding cutting blades projecting from the plane thereof in the said space, and in planes transverse to the plane of said fixed cutting blade and intermediate the planes of said cutting blades of said first plate means,
(e) whereby to cut foodstuffs into strips.

2. Apparatus as defined in claim 1, wherein the first plate means comprises side walls, said side walls comprising said guide means.

3. Apparatus as defined in claim 1, said first plate means and said second plate means each comprising a thin, flat plate in facing, abutting partially overlapping relationship, said plate of said first plate means being imperforate and said cutting blades thereof extending from portions thereof not overlapped by said plate of said second plate means.

4. Apparatus as defined in claim 1, wherein the second substantially flat plate means has notches along one side between two adjacent blades as considered in the cutting direction of the apparatus for receiving a respective blade of the first substantially flat plate means.

5. Apparatus as defined in claim 4, wherein the fixed cutting blade of said substantially flat body is of 'V'-shape, the blades of the first and second plate means also being arranged in a 'V'-formation transversely of the respective plate means, both sides of each plate means having notches between adjacent blades.

6. Apparatus as defined in claim 1, wherein the first and second plate means have a free side adjacent their respective blades, which free sides converge to an apex.

7. Apparatus as defined in claim 6, in which there is a notch at the apex of the second plate means for receiving an apical blade of the 'V'-formation of the one blade.

* * * * *